US008420963B2

(12) United States Patent
Bhathija et al.

(10) Patent No.: US 8,420,963 B2
(45) Date of Patent: Apr. 16, 2013

(54) ELECTRICAL ENCLOSURE APPARATUS

(75) Inventors: Kuldeep Kumar Bhathija, Hyderabad-Andhra Pradesh (IN); Jeffery Cox, Selmer, TN (US); Clarence Wilson Walker, Selmer, TN (US)

(73) Assignee: General Electric Company, Schenectady, NY (US)

( * ) Notice: Subject to any disclaimer, the term of this patent is extended or adjusted under 35 U.S.C. 154(b) by 533 days.

(21) Appl. No.: 12/646,230

(22) Filed: Dec. 23, 2009

(65) Prior Publication Data

US 2011/0147171 A1 Jun. 23, 2011

(51) Int. Cl.
*H01H 9/20* (2006.01)
*H01H 9/22* (2006.01)
*H01H 33/46* (2006.01)

(52) U.S. Cl.
USPC ..... 200/50.12

(58) Field of Classification Search ..... 200/50.12
See application file for complete search history.

(56) References Cited

U.S. PATENT DOCUMENTS 4,074,091 A * 2/1978 Bischof et al. ..... 200/50.15
4,305,610 A * 12/1981 Piteo et al. ..... 292/152
4,659,884 A 4/1987 Wollenhaupt
4,912,599 A 3/1990 Wittmer
5,663,862 A 9/1997 Hopping-Mills
6,023,030 A 2/2000 Latimer et al.

* cited by examiner

*Primary Examiner* — Renee Luebke
*Assistant Examiner* — Lheiren Mae Caroc
(74) *Attorney, Agent, or Firm* — Global Patent Operation; Stephen G. Midgley

(57) ABSTRACT

An openable cover for an enclosure configured to house a switching device, the switching device being configured with an operating member operable between a first position and a second position. The openable cover comprises a moveable member operable in response to movement of the operating member. The movable member is configured to prevent opening of the cover member when the operating member is in the first position, and configured to prevent closing of the cover member when the operating member is in the second position.

12 Claims, 3 Drawing Sheets

ELECTRICAL ENCLOSURE APPARATUS

BACKGROUND OF THE INVENTION

1. Field of the Invention

The field of the present invention relates to an enclosure for an electrical device generally, and more particularly to an interlockable enclosure cover for a switch, such as a circuit breaker, of which the following is a specification, reference being had to the drawings accompanying and forming a part of the same.

2. Description of the Related Art

In conventional electrical distribution and control systems, electrical switching devices such as circuit breakers for switching power ON and OFF are often enclosed in an housing having an openable cover. Such housings are typically of metallic or polymeric material and include a hinged door or removeable cover providing access to the interior of the housing. Non-limiting examples of conventional electrical device housings include switch enclosures, busway "busplugs", motor control centers, panelboards, and switchgear.

In FIGS. 1A and 1B, a conventional switch device enclosure 100 is shown, having a switching device, such as a circuit breaker or switch 101 having an operating member 103 for switching power installed therein. A hinged cover or door 104 is openable via hinges 133*a*, 133*b* to provide access to the interior of enclosure 100. The door 104 is retained in a closed position by fasteners such as screws (not shown) and/or any number of releasable door-latching mechanisms having a biased releasable latch member 108 arranged to protrude through an aperture 110 in the door 104. Such latch members 108 are provided with an aperture 112 configured to receive a locking member (not shown) such as the hasp of a lock (not shown) for locking the cover 104 closed.

When closed, the door 104 prevents direct operative access to the operating member 103 of the enclosed switch 101. Operating handle 102 mounted external to the enclosure 100 and movable in the directions indicated by arrow 119 is configured to drive a mechanism including, for example, a moveable yoke 105, which in turn drives the operating member 103 of switch 101 for toggling the switch 101 from a power ON position to a power OFF position. Labels (not shown) having text such as "ON" and "OFF", are positioned on enclosure 100 to correspond to operating handle 102 positions that likewise correspond to, and thus indicate, the state of the enclosed switch 101.

Various electrical standards require, as a safety feature, an interlock or latch mechanism to prevent opening of the door or removal of the cover while the enclosed switch is in the ON or conducting state. Prior art interlock assemblies 141 are conventionally configured to cooperate with a mechanism 142 driven by the externally-mounted operating handle 102 to prevent the opening of the door 104 while the enclosed switch 101 is in the ON or conducting state.

While safety latch assemblies for enclosures are generally known in the art, they have certain disadvantages. They are generally complex and expensive, often with a relatively large number of parts, and some permit closing of the cover 104 with the enclosed switch 101 in the ON position. This latter disadvantage can result in the enclosed switch 101 being in an ON or conducting state while the external operating member 102 position incorrectly indicates that the enclosed switch 101 is in an OFF or non-conducting state, thus resulting in a potentially hazardous condition.

It is desirable to provide an improved device configured to allow direct external operability of a switch or circuit interrupter installed in a housing, with a simpler, low cost apparatus to prevent opening and/or closing of the enclosure cover when the enclosed switch is in the "ON" position.

BRIEF SUMMARY OF THE INVENTION

In view of the foregoing considerations, it is desirable to provide a device to provide an enclosure having a safety latch assembly that is relatively simple in construction, using a minimum number of parts that prohibits closing of the enclosure cover with the enclosed switch in the ON position, and preferably prevents both closing and opening of the enclosure cover with the enclosed switch in the ON position.

In an embodiment, an enclosure for a switching device having an operating member operable between a first ON and a second OFF position is provided. The enclosure comprises a simple latch assembly that is configured to move in response to the operation of the enclosed switching device operating member to prevent opening of the enclosure when the enclosed switch 101 is in the first ON position.

In another embodiment, an openable cover for an enclosure configured to house a switching device configured with an operating member operable between a first ON and a second OFF position, is provided. The openable cover comprises a moveable member operable in response to movement of the switching device operating member and is configured to prevent opening of the cover member when the operating member is in the first ON position.

Other features and advantages of the disclosure will become apparent by reference to the following description taken in connection with the accompanying drawings.

BRIEF DESCRIPTION OF THE DRAWINGS

Although specific features of the invention are shown in some drawings and not in others, this is for convenience only as one or more of the features of any drawing may be combined with any or all of the other features of one or more of the remaining drawings in accordance with one or more embodiments of the invention.

The accompanying drawings, which are incorporated in and constitute a part of the specification, illustrate a presently preferred embodiment of the invention, in which.

DETAILED DESCRIPTION OF THE PREFERRED EMBODIMENTS

Figure 1A:
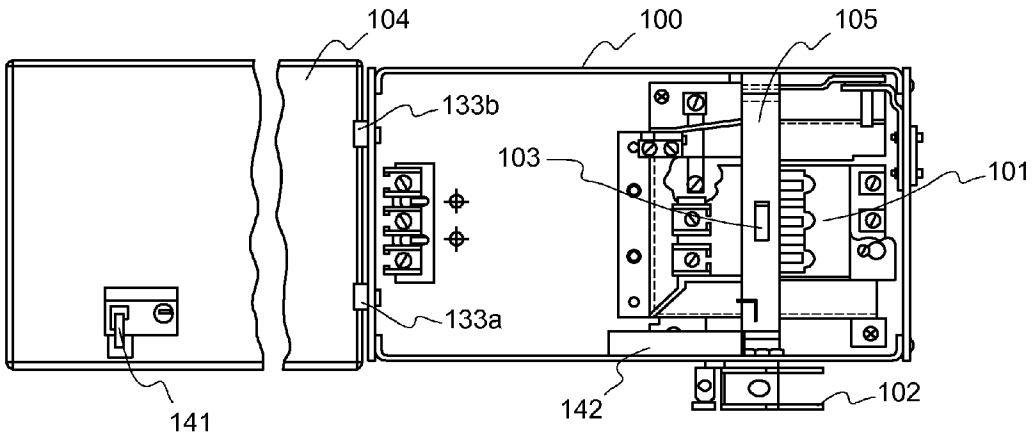
FIG. 1A (PRIOR ART)
FIG. 1A illustrates a top view of a prior art switch housing having an interlock mechanism.
Figure 1B:
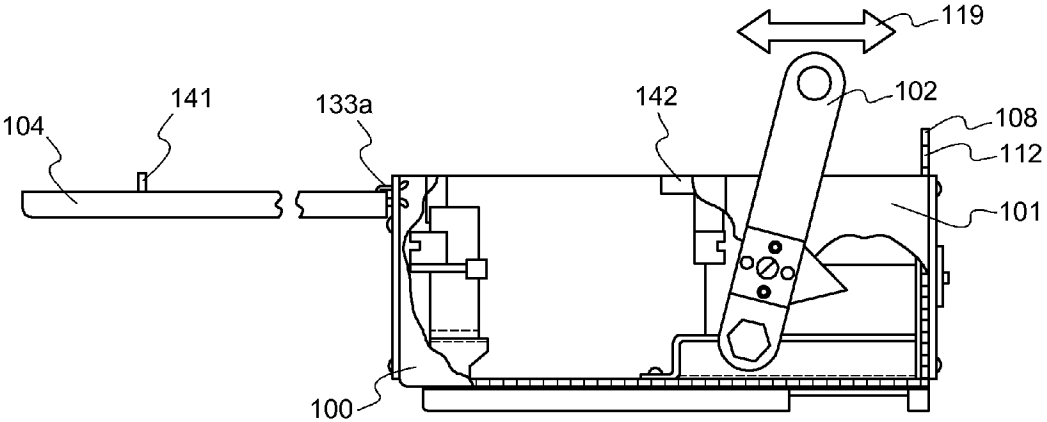
FIG. 1B (PRIOR ART)
FIG. 1B illustrates a side view, with partial cut-away, of the prior art switch housing of FIG. 1A.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Referring now to the drawings, wherein like reference numerals designate identical or corresponding parts throughout the several views.

Figure 2:
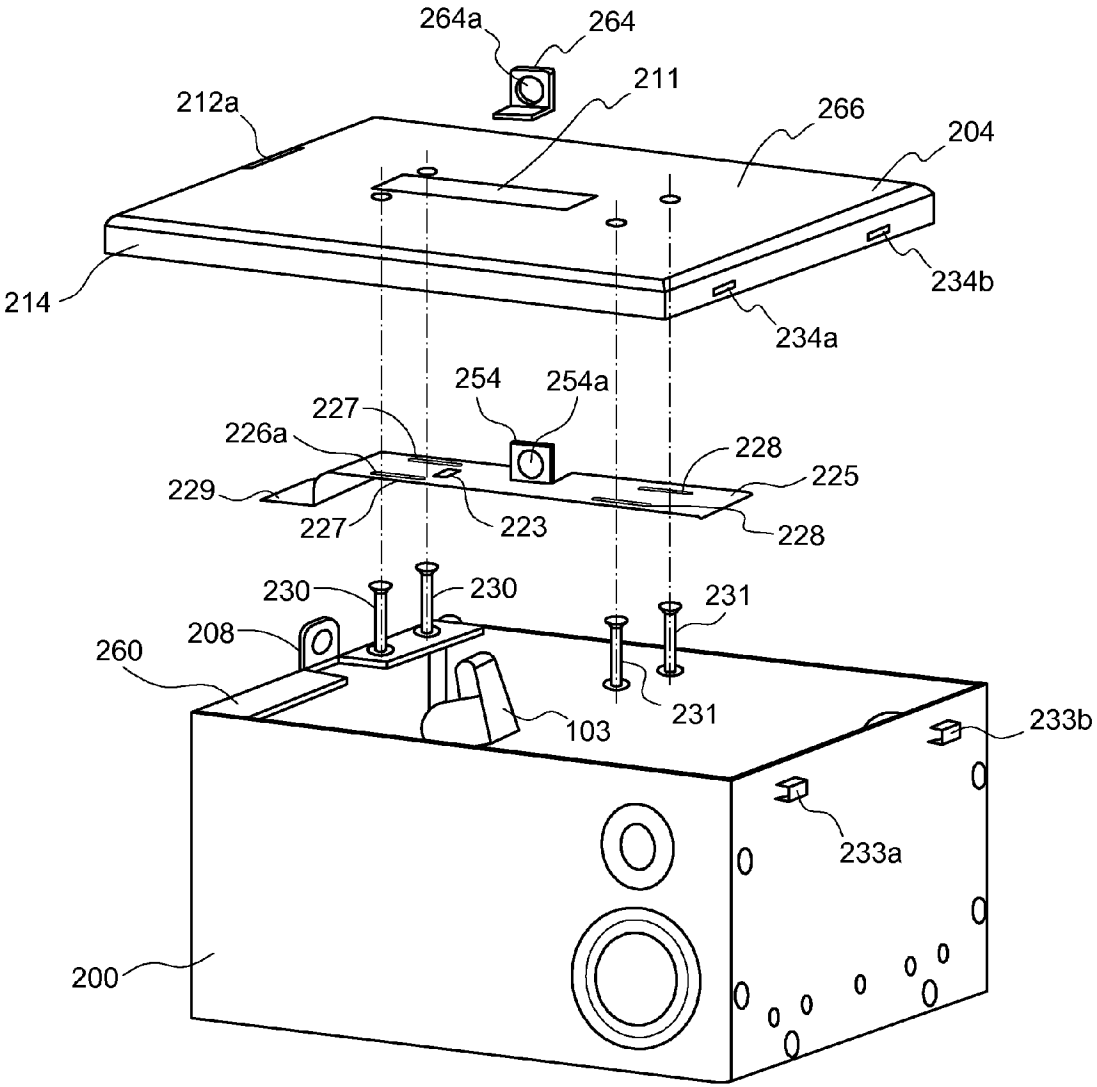
FIG. 2 is an exploded view illustrating an embodiment of the present invention.

In FIG. 2, a housing 200 configured to enclose a conventional switching device 101, such as a circuit breaker or switch having an operating member 103 for toggling the switch 101 from a power ON position to a power OFF position installed therein is shown. A cover or door 204 having a first interior surface 256 (FIG. 3) and a second exterior surface 266 is openable to provide access to the interior of the housing 200. The cover 204 is provided with a first aperture 211, configured to allow the installed switch 101 operating member 103 to protrude therethrough when the cover 204 is closed. The first aperture 211 is dimensioned to allow operating member 103 to travel through its full operable range of motion to allow operation of the switch 101.

The door 204 may be retained in a closed position by fasteners such as screws 206*a*, 206*b* and/or any number of releasable door-latching mechanisms having a latch member 208 arranged to protrude through a second aperture 212*a* in the door 204. Latch member 208 is provided with an aperture 212*b* configured to receive a locking member (not shown) such as the hasp of a lock (not shown) for locking the cover 204 closed. It is contemplated that in some embodiments, the door 204 may be hingeably attached to the enclosure 200, such as, for example, with hinges 233*a*, 233*b* cooperating with apertures 234*a*, 234*b*.

An interlock member 225 having a top surface 226*a* and a bottom surface 226*b* (FIG. 3) is movably connected to the first interior surface 256 of door 204 and configured to move in response to movement of a switching device operating member 103 installed in the housing 200. Preferably, cover 204 is configured such that when the cover 204 is closed, the interlock member 225 is not accessible from the exterior of housing 200. For example, door 204 may additionally comprise at least one flange 214 formed generally orthogonal to top surface 226*a* and configured to cooperate with enclosure 200 to prevent access to interlock member when door 204 is closed.

In an embodiment, interlock member 225 is provided with a third notch, opening, or aperture 223, positioned to allow the switch 101 operating member 103 to protrude therethrough when the cover 204 is closed. Interlock member 225 aperture 223 and cover 204 aperture 211 are configured to cooperate to allow the installed switch 101 operating handle 103 to protrude external to the housing 200 and to allow direct operation of the switch 101 operating handle 103. In order to allow operation of switch 101 when the cover 204 is closed, the interlock member 225 aperture 223 is configured such that movement of the switch operating member 103 causes movement of the interlock member 225.

It is contemplated that the movable connection of interlock member 225 to door 204 may be accomplished through a variety of ways. For example, in one embodiment, two fasteners or shouldered rivets 230, 231 connect interlock member 225 to the first interior surface 256 door 204. Two or more generally parallel slots 227, 228 are disposed in interlock member 225 and are configured to slidably capture respective shouldered rivets 230, 231. A first end of each of the rivets 230, 231 are fixedly attached to door 204 via peening or other known methods. A second end of the at least two rivets 230, 231 are disposed through respective slots 227, 228 in interlock member 225.

Figure 3:
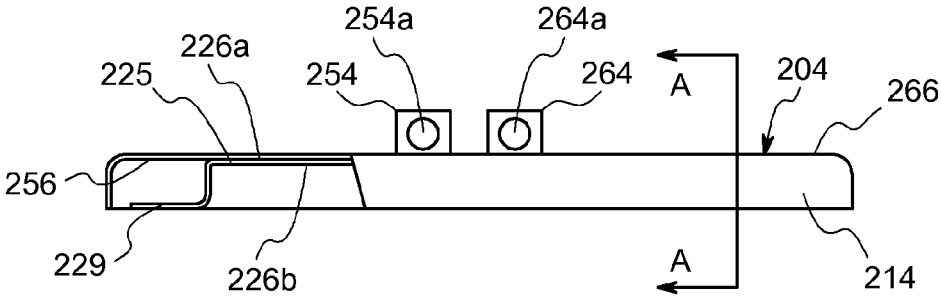
FIG. 3 is a side view with partial cutaway of an embodiment of a cover of the present invention.
Figure 4:
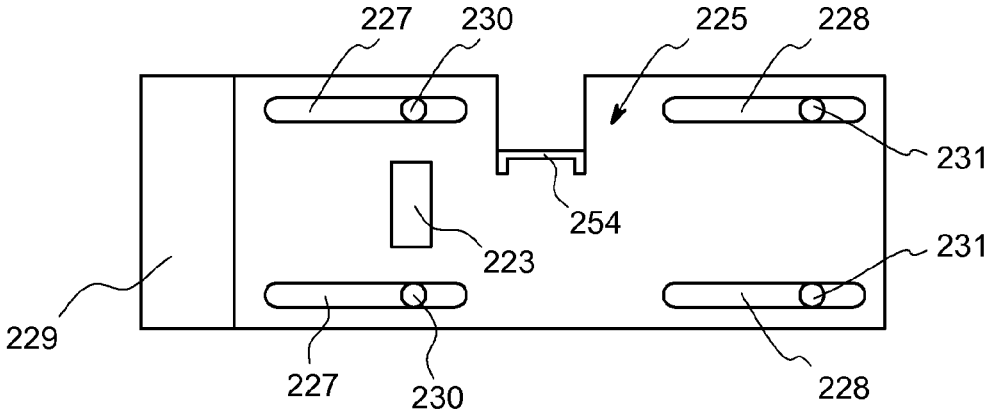
FIG. 4 is a top view of an embodiment of an interlock member of the present invention.
Figure 5:
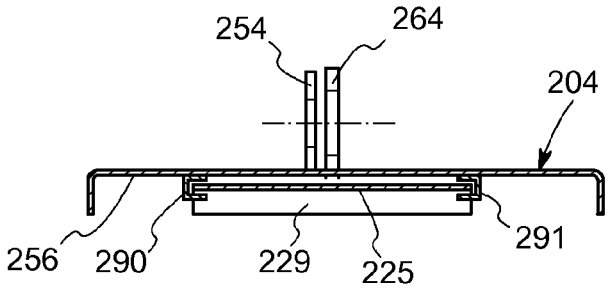
FIG. 5 is a cross-section end view of the embodiment of FIG. 3.

FIG. 5 illustrates a cross-section end view of the embodiment of FIG. 3 looking in the direction of A-A of FIG. 3. In an embodiment, two generally U-shaped brackets 290, 291 are attached via known methods, such as welding, to the first interior surface 256 of door 204 and disposed to slidably support interlock member 225 adjacent the first interior surface 256 of door 204.

Referring again to FIG. 2, an interlock formation 260 is provided on housing 200 and oriented to latchably engage a corresponding latching portion 229 of interlock member 225 to prevent opening of door 204 when the enclosed switch 101 operating member 103 is in the ON position. Conversely, interlock formation 260 is further arranged such that, when the enclosed switch 101 operating member 103 is in the OFF position, the corresponding latching portion 229 of interlock member 225 is not latchably engaged by the interlock formation 260.

It is contemplated that the interlock formation 260 may embody a variety of forms to accommodate a latching function in cooperation with the corresponding latching portion 229 of interlock member 225. In one exemplary embodiment, and as shown in FIG. 2, a portion of housing 200 is configured in the form of a tab 260 oriented to latchably engage the corresponding latching portion 229 of interlock member 225 when the enclosed switch 101 operating member 103 is in the ON position and door 204 is closed. When the enclosed switch 101 operating member 103 is moved to the OFF position, the corresponding latching portion 229 of interlock member 225 is released, or unlatched, from the interlock formation 260, and the door 204 may be opened. Additionally, interlock formation 260 is disposed to cooperate with latching portion 229 of interlock member 225 to prevent closure of door 204 when door 204 is open and the enclosed switch 101 operating member 103 is in the ON position.

Referring to FIG. 2 and FIG. 3, interlock member 225 may additionally be configured with a first locking tab 254 configured to cooperate with a corresponding second locking tab 264 disposed on door 204. First locking tab 254, and second locking tab 264 are formed generally orthogonal to top surface 226*a* of door 200. First locking tab 254 is configured with a first aperture 254*a*, and second locking tab 264 is configured with a second aperture 264*a*. First aperture 254*a*, and second aperture 264*a* are disposed to receive a locking member (not shown) such as the hasp of a lock (not shown) for locking the enclosed switch 101 operating member 103 in the OFF position when door 200 is closed.

With respect to the above description, it should be realized that the optimum dimensional relationships for the parts of the invention, to include variations in size, form function and manner of operation, assembly and use, are deemed readily apparent and illustrated in the drawings and described in the specification are intended to be encompassed only by the scope of appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope claims, or if they include equivalent structural elements with insubstantial differences from the literal languages of the claims.

What is claimed is:

1. An enclosure for a switching device, the switching device being configured with an operating member operable between a first ON position and a second OFF position, the enclosure comprising:

a housing configured to support the switching device, said housing comprising an interlock formation:

a housing cover operable between a first closed position and a second open position, said housing cover configured with an aperture therethough;

an interlock member moveably connected to said cover, said interlock member defining an aperture therethrough sized to operatively receive the switching device operating member, the interlock member operative to move in response to movement of switching device operating member;

said interlock member configured to engage said housing interlock formation to prevent movement of said housing cover from said first closed position to said second open position when the switching device operating member is in the first ON position; and wherein said interlock member aperture and said cover aperture are configured to cooperate to permit the switching device operating member to operably protrude from said housing when said housing cover is in the first closed position.

2. The enclosure of claim 1, wherein said interlock member is further configured to prevent movement of said housing cover from said second open position to said first closed, position when the switch device operating member is in the second OFF position.

3. The enclosure of claim 1, wherein said interlock member is movably connected to said housing cover by fasteners.

4. The enclosure of claim 3, wherein said fasteners are shouldered rivets.

5. The enclosure of claim 1, wherein said interlock formation comprises a tab.

6. The enclosure of claim 1, wherein said interlock formation comprises an aperture.

7. An openable cover for a housing for a switching device, the switching device being configured with an operating member operable between a first ON position and a second OFF position, the openable cover comprising:

a first aperture defined therethrough; and an interlock member moveably coupled to said cover, defining a second aperture therethrough sized to operatively receive the switching device operating member, said interlock member operative to move in response to movement of the switching device operating member;

said interlock member configured to engage a formation in the housing to prevent opening, of said cover when the switching device operating member is in the first ON position; wherein said cover first aperture and said interlock member second aperture are configured to cooperate to permit the switching device operating member to operably protrude from said housing when said housing cover is in the first closed position.

8. The cover of claim 7, wherein said interlock member is further configured to prevent closing of said cover when the switch device operating member is in the second OFF position.

9. The enclosure of claim 7, wherein said interlock member is movably connected to said housing cover by fasteners.

10. The enclosure of claim 9, wherein said fasteners are shouldered rivets.

11. The enclosure of claim 7, wherein said interlock formation comprises a tab.

12. The enclosure of claim 7, wherein said interlock formation comprises an aperture.

* * * * *

UNITED STATES PATENT AND TRADEMARK OFFICE

CERTIFICATE OF CORRECTION

PATENT NO. : 8,420,963 B2
APPLICATION NO. : 12/646230
DATED : April 16, 2013
INVENTOR(S) : Bhathija et al.

It is certified that error appears in the above-identified patent and that said Letters Patent is hereby corrected as shown below:

In the Claims

In Column 4, Line 67, in Claim 1, delete "formation:" and insert -- formation; --, therefor.

In Column 5, Line 3, in Claim 1, delete "therethough;" and insert -- therethrough; --, therefor.

In Column 5, Line 8, in Claim 1, delete "of switching" and insert -- of the switching --, therefor.

In Column 5, Line 22, in Claim 2, delete "closed," and insert -- closed --, therefor.

In Column 6, Line 12, in Claim 7, delete "opening," and insert -- opening --, therefor.

Signed and Sealed this
Sixteenth Day of July, 2013

Teresa Stanek Rea
*Acting Director of the United States Patent and Trademark Office*